US010975499B2

(12) United States Patent
Pande et al.

(10) Patent No.: US 10,975,499 B2
(45) Date of Patent: Apr. 13, 2021

(54) SURFACE ENHANCED PULP FIBERS, METHODS OF MAKING SURFACE ENHANCED PULP FIBERS, PRODUCTS INCORPORATING SURFACE ENHANCED PULP FIBERS, AND METHODS OF MAKING PRODUCTS INCORPORATING SURFACE ENHANCED PULP FIBERS

(71) Applicant: Domtar Paper Company, LLC, Fort Mill, SC (US)

(72) Inventors: Harshad Pande, Pointe-Claire (CA); Bruno Marcoccia, Charlotte, NC (US)

(73) Assignee: DOMTAR PAPER COMPANY, LLC, Fort Mill, SC (US)

( * ) Notice: Subject to any disclaimer, the term of this patent is extended or adjusted under 35 U.S.C. 154(b) by 125 days.

(21) Appl. No.: 15/225,292

(22) Filed: Aug. 1, 2016

(65) Prior Publication Data

US 2016/0333524 A1 Nov. 17, 2016

Related U.S. Application Data

(63) Continuation of application No. 13/836,760, filed on Mar. 15, 2013, now Pat. No. 9,879,361.

(Continued)

(51) Int. Cl.
*D21H 15/02* (2006.01)
*D01B 9/00* (2006.01)

(Continued)

(52) U.S. Cl.
CPC ..... *D01B 9/00* (2013.01); *D02J 3/02* (2013.01); *D21B 1/04* (2013.01); *D21C 9/007* (2013.01);

(Continued)

(58) Field of Classification Search
CPC ..... D21H 15/02
See application file for complete search history.

(56) References Cited

U.S. PATENT DOCUMENTS 3,098,785 A 7/1963 Meiler
3,388,037 A 6/1968 Asplund (Continued)

FOREIGN PATENT DOCUMENTS

AU 2015218812 7/2017
AU 2013305802 8/2017

(Continued)

OTHER PUBLICATIONS

Declaration of Harshad Pande and Bruno Marcoccia, U.S. Appl. No. 13/836,760, dated Oct. 12, 2016 (Year: 2016).*

(Continued)

*Primary Examiner* — Andrew T Piziali
(74) *Attorney, Agent, or Firm* — Norton Rose Fulbright US LLP

(57) ABSTRACT

Various embodiments of the present invention relate to surface enhanced pulp fibers, various products incorporating surface enhanced pulp fibers, and methods and systems for producing surface enhanced pulp fibers. Various embodiments of surface enhanced pulp fibers have significantly increased surface areas compared to conventional refined fibers while advantageously minimizing reductions in length following refinement. The surface enhanced pulp fibers can be incorporated into a number of products that might benefit from such properties including, for example, paper products, paperboard products, fiber cement boards, fiber reinforced plastics, fluff pulps, hydrogels, cellulose acetate products, and carboxymethyl cellulose products. In some embodiments, a plurality of surface enhanced pulp fibers have a length weighted average fiber length of at least about 0.3 millimeters and an average hydrodynamic specific surface (Continued)

area of at least about 10 square meters per gram, wherein the number of surface enhanced pulp fibers is at least 12,000 fibers/milligram on an oven-dry basis.

30 Claims, 2 Drawing Sheets

Related U.S. Application Data

(60) Provisional application No. 61/692,880, filed on Aug. 24, 2012.

(51) Int. Cl.

| | |
|---|---|
| ***D21B 1/04*** | (2006.01) |
| ***D21D 1/26*** | (2006.01) |
| ***D21D 1/06*** | (2006.01) |
| ***D21C 9/00*** | (2006.01) |
| ***D21D 1/20*** | (2006.01) |
| ***D21H 11/08*** | (2006.01) |
| ***D21H 11/10*** | (2006.01) |
| ***D21H 11/16*** | (2006.01) |
| ***D02J 3/02*** | (2006.01) |
| ***D21H 11/00*** | (2006.01) |

(52) U.S. Cl.

CPC ..... *D21D 1/06* (2013.01); *D21D 1/20* (2013.01); *D21D 1/26* (2013.01); *D21H 11/00* (2013.01); *D21H 11/08* (2013.01); *D21H 11/10* (2013.01); *D21H 11/16* (2013.01); *D21H 15/02* (2013.01); *Y10T 428/298* (2015.01)

(56) References Cited

U.S. PATENT DOCUMENTS

| | | | | |
|---|---|---|---|---|
| 3,708,130 | A | 1/1973 | Perry | |
| 3,794,558 | A | 2/1974 | Back | |
| 3,920,508 | A * | 11/1975 | Yonemori | D01D 5/11 162/157.5 |
| 3,966,543 | A | 6/1976 | Cayle et al. | |
| 4,012,279 | A | 3/1977 | Selander | |
| 4,247,362 | A * | 1/1981 | Williams | A61L 15/28 162/13 |
| 4,635,864 | A | 1/1987 | Peterson | |
| 4,895,019 | A | 1/1990 | Lehmikangas et al. | |
| 5,110,412 | A | 5/1992 | Fuentes et al. | |
| 5,248,099 | A | 9/1993 | Lahner et al. | |
| 5,308,449 | A | 5/1994 | Fuentes et al. | |
| 5,695,136 | A | 12/1997 | Rohden | |
| 5,731,080 | A | 3/1998 | Cousin et al. | |
| 5,824,364 | A | 10/1998 | Cousin et al. | |
| 5,954,283 | A | 9/1999 | Matthew | |
| 6,156,118 | A | 12/2000 | Silenius et al. | |
| 6,165,317 | A | 12/2000 | Sabourin | |
| 6,251,222 | B1 | 6/2001 | Silenius et al. | |
| 6,296,736 | B1 | 10/2001 | Hsu et al. | |
| 6,375,974 | B1 | 4/2002 | Ito et al. | |
| 6,599,391 | B2 | 7/2003 | Silenius et al. | |
| 6,773,552 | B1 | 8/2004 | Albert et al. | |
| 6,861,380 | B2 | 3/2005 | Garnier et al. | |
| 6,887,350 | B2 | 5/2005 | Garnier et al. | |
| 6,935,589 | B1 | 8/2005 | Matthew | |
| 6,955,309 | B2 | 10/2005 | Matthew et al. | |
| 7,381,294 | B2 | 6/2008 | Suzuki et al. | |
| 7,624,879 | B2 | 12/2009 | Frances | |
| 7,741,234 | B2 | 6/2010 | Smith | |
| 7,942,964 | B2 | 5/2011 | Luo et al. | |
| 8,871,057 | B2 | 10/2014 | Gane | |
| 9,879,361 | B2 | 1/2018 | Pande et al. | |
| 9,920,484 | B2 | 3/2018 | Marcoccia | |
| 2002/0059886 | A1 | 5/2002 | Merkley et al. | |
| 2002/0069791 | A1 | 6/2002 | Merkley et al. | |
| 2002/0084046 | A1 | 7/2002 | Hsu et al. | |
| 2004/0112558 | A1 | 6/2004 | Garnier et al. | |
| 2004/0112997 | A1 | 6/2004 | Matthew et al. | |
| 2004/0180184 | A1 | 9/2004 | Fillion | |
| 2004/0241350 | A1 | 12/2004 | Koga et al. | |
| 2005/0194477 | A1 | 9/2005 | Suzuki | |
| 2006/0006264 | A1 | 1/2006 | Sabourin et al. | |
| 2007/0164143 | A1 | 7/2007 | Sabourin et al. | |
| 2008/0148999 | A1 | 6/2008 | Luo et al. | |
| 2008/0227161 | A1 | 9/2008 | Levie et al. | |
| 2009/0145562 | A1 | 6/2009 | Nguyen | |
| 2009/0145842 | A1 | 6/2009 | Frances | |
| 2009/0162602 | A1 | 6/2009 | Cottier et al. | |
| 2009/0221812 | A1 | 9/2009 | Ankerfors et al. | |
| 2010/0065236 | A1 | 3/2010 | Henriksson et al. | |
| 2010/0218908 | A1 | 9/2010 | Silenius et al. | |
| 2010/0288456 | A1 | 11/2010 | Westland et al. | |
| 2011/0277947 | A1 | 11/2011 | Hua et al. | |
| 2011/0314726 | A1 | 12/2011 | Jameel et al. | |
| 2012/0007363 | A1 | 1/2012 | Wang | |
| 2012/0012031 | A1 | 1/2012 | Husband et al. | |
| 2013/0202870 | A1 | 8/2013 | Malmborg et al. | |
| 2014/0057105 | A1 | 2/2014 | Pande et al. | |
| 2014/0116635 | A1 | 5/2014 | Porto et al. | |
| 2014/0180184 | A1 | 6/2014 | Duguid | |
| 2014/0209260 | A1 | 7/2014 | Li et al. | |
| 2015/0299955 | A1 | 10/2015 | Laukkanen et al. | |
| 2016/0333524 | A1 | 11/2016 | Pande | |
| 2016/0340802 | A1 | 11/2016 | Pande | |
| 2017/0058457 | A1 | 3/2017 | Marcoccia | |
| 2017/0226009 | A1 | 8/2017 | Marcoccia et al. | |
| 2018/0105986 | A1 | 4/2018 | Harshad et al. | |
| 2019/0242062 | A1 | 8/2019 | Harshad et al. | |

FOREIGN PATENT DOCUMENTS

| | | |
|---|---|---|
| CA | 2883181 | 3/2017 |
| CN | 1516768 | 7/2004 |
| CN | 1718914 | 1/2006 |
| CN | 101691700 | 4/2010 |
| CN | 102971462 | 3/2013 |
| CN | 103590283 | 2/2014 |
| EP | 0333209 | 9/1989 |
| EP | 0333212 | 9/1989 |
| EP | 2220291 | 5/2017 |
| JP | S58-136895 | 8/1983 |
| JP | H02229747 | 9/1990 |
| JP | H03122038 | 5/1991 |
| JP | H04194097 | 7/1992 |
| JP | H 04263699 | 9/1992 |
| JP | H07165456 | 6/1995 |
| JP | H08197836 | 8/1996 |
| JP | H08284090 | 10/1996 |
| JP | H09-124950 | 5/1997 |
| JP | 2002194691 | 7/2002 |
| JP | 2004525284 | 8/2004 |
| JP | 2004360088 | 12/2004 |
| JP | 2007231438 | 9/2007 |
| JP | 2010125694 | 6/2010 |
| JP | 2012526923 | 11/2012 |
| JP | 2015526608 | 9/2015 |
| KR | 2004/0022874 | 3/2004 |
| KR | 1020050086850 | 8/2005 |
| KR | 10-0662043 B | 12/2006 |
| KR | 10-2010-0090745 A | 8/2010 |
| KR | 1020130132381 | 12/2013 |
| RU | 2224060 | 2/2004 |
| RU | 2309211 | 10/2007 |
| RU | 2358055 | 6/2009 |
| WO | WO 96/04424 | 2/1996 |
| WO | WO 98/23814 | 6/1998 |
| WO | WO 02/14606 | 2/2002 |
| WO | 02095129 | 11/2002 |
| WO | WO 2004/101889 | 11/2004 |
| WO | WO 2009/038730 | 3/2009 |
| WO | WO 2009/155541 | 12/2009 |
| WO | WO 2010/134868 | 11/2010 |
| WO | 2012007363 | 1/2012 |
| WO | WO 2012/101331 | 8/2012 |

(56) References Cited

FOREIGN PATENT DOCUMENTS

| | | |
|---|---|---|
| WO | 2014031737 | 2/2014 |
| WO | WO 2014/106684 | 7/2014 |
| WO | 2015127233 | 8/2015 |
| WO | 2015127239 | 8/2015 |
| WO | WO 2018/026804 | 2/2018 |
| WO | WO 2018/051275 | 3/2018 |

OTHER PUBLICATIONS

Handbook of Pulping and Papermaking, C. Biermann, Academic Press; 2nd Edition (Aug. 5, 1996), p. 145.
Pande, Hanshad; Final Office Action for U.S. Appl. No. 13/836,760, filed Mar. 15, 2013, dated May 12, 2016, 10 pgs.
Pande, Harshad; Non-Final Office Action for U.S. Appl. No. 13/836,760, filed Mar. 15, 2013; dated Oct. 15, 2015 10 pgs.
Pande, Harshad; Restriction Requirement for U.S. Appl. No. 13/836,760, filed Mar. 15, 2013, dated Jul. 16, 2015, 8 pgs.
Teixeira. Article entitled: "Recycled Old Corrugated Container Fibers for Wood-Fiber Cement Sheets"; International Scholarly Research Network 2012(923413): 1-8, 2012, 9 pgs.
Marcoccia, Bruno; International Preliminary Report on Patentability for PCT Application No. PCT/US2015/016865, filed Feb. 20, 2015, dated Aug. 23, 2016, 7 pgs.
Marcoccia, Bruno; International Search Report and Written Opinion for PCT Application No. PCT/US2015/016865, filed Feb. 20, 2015, dated May 20, 2015, 8 pgs.
Marcoccia, Bruno; International Preliminary Report on Patentability for PCT Application No. PCT/US2015/016858, filed Feb. 20, 2015, dated Aug. 23, 2016, 8 pgs.
Marcoccia, Bruno; International Search Report and Written Opinion for PCT Application No. PCT/US2015/016858, filed Feb. 20, 2015, dated May 15, 2015, 9 pgs.
Marcoccia, Bruno; U.S. Provisional Application entitled: Surface Enhanced Pulp Fibers, Methods of Making Surface Enhanced Pulp Fibers, Products Incorporating Surface Enhanced Pulp Fibers, and Methods of Making Products Incorporating Surface Enhanced Pulp Fibers, having U.S. Appl. No. 61/692,880, filed Aug. 24, 2012, 23 pgs.
Marcoccia; Bruno; U.S. Provisional Application entitled: Surface Enhanced Pulp Fibers at the Substrate Surface: Solutions, Methods of Application and Enhanced Properties, having U.S. Appl. No. 61/942,694, filed Feb. 21, 2014, 58 pgs.
Marcoccia, Bruno; U.S. Provisional Application entitled: Surface Enhanced Pulp Fibers in Fiber Cement , having U.S. Appl. No. 61/942,708, filed Feb. 21, 2014, 58 pgs.
Marcoccia, Bruno; U.S. Provisional Application entitled: Improved Composition of Lignin and Surface-Enhanced Pulp Fiber, having U.S. Appl. No. 62/189,569, filed Jul. 7, 2015, 5 pgs.
La Vrykova-Marrain et al., Article entitled: "Characterizing the drainage resistance of pup and microfibrillar suspensions using hydrodynamic flow measurements", TAPPI's PaperCon 2012 Conference, 38 pgs.
Pal, et al., "A Simple Method for Calculation of the Permeability Coefficient of Porous Media". Tappia Journal, 5(9):10-16, 2006.
Pande, Harshad; International Preliminary Report on Patentability for PCT/US2013/055971, filed Aug. 21, 2013, dated Feb. 24, 2015, 7 pgs.
Pande, Harshad, International Search Report and Written Opinion for PCT/US2013/055971, filed Aug. 21, 2013, dated Oct. 14, 2013, 9 pgs.
Marcoccia, Bruno; Notice of Allowance for U.S. Appl. No. 15/120,220, filed Aug. 19, 2016, dated Nov. 6, 2017, 11 pgs.
Tonoli, et al.; Article entitled: "Effect of fibre morphology on flocculation of fibre-cement suspensions", Cement and Concrete Research 39 (2009) 1017-1022, published on Nov. 1, 2009, 6 pgs.
Marcoccia, Bruno; International Search Report and the Written Opinion for PCT Application No. PCT/US 17/44881, filed Aug. 1, 2017, dated Oct. 18, 2017, 9 pgs.
Pande, Harshad; Applicant Initiated Interview Summary for U.S. Appl. No. 13/836,760, filed Mar. 15, 2013, dated Sep. 27, 2017, 3 pgs.
Marcoccia, Bruno; Non-Final Office Action for U.S. Appl. No. 15/120,220, filed Aug. 19, 2016, dated Jul. 13, 2017, 26 pgs.
Pande, Harshad; Intention to grant for European patent application No. 13759601.1, filed Aug. 21, 2013, dated Jul. 25, 2017, 45 pgs.
International Search Report and Written Opinion Issued in PCT Application No. PCT/US2017/057161, dated Dec. 22, 2017.
Notice of Allowance Issued in Chinese Patent Application No. 201580020488.7, dated Apr. 12, 2018.
Office Action Issued in Japanese Application No. 148632, dated Apr. 10, 2018.
Pande, Harshad; Final Office Action for U.S. Appl. No. 13/838,760, filed Mar. 15, 2013, dated Jan. 27, 2017, 16 pgs.
Pande, Harshad; Notice of Allowance for Canadian Patent Application No. 2,883,161, filed Aug. 21, 2013, dated Jan. 3, 2017, 1 pg.
Extended European Search Report issued in European Application No. 17195921.6, dated Nov. 20, 2017.
Notice of Grant for Chinese Application No. 201380054919.2, dated Nov. 14, 2017.
Pande, Harshad: Applicant Initiated Interview Summary for U.S. Appl. No. 13/836,780, filed Mar. 15, 2013, dated May 9, 2017, 3 pgs.
Domtar Paper Company, LLC; Notice of Acceptance for Australian application No. 2013306802, filed Feb. 23, 2015, dated Apr. 21, 2017, 3 pgs.
Domtar Paper Company, LLC; Notice of Acceptance for New Zealand application No. 705191, filed Aug. 21, 2013, dated Apr. 13, 2017, 1 pg.
International Search Report and Written Opinion issued in International Patent Application No. PCT/US2019/016590, dated May 23, 2019.
Declaration of Harshad Pande and Bruno Marcoccia, filed in U.S. Appl. No. 13/836,760, dated Oct. 12, 2016.
Notice of Reasons for Refusal issued in Japanese Patent Application No. 2018-090071, dated May 15, 2019.
Office Action issued in Indian Patent Application No. 465/KOLNP/2015, dated May 7, 2019.
Office Action issued in Russian Patent Application No. 2018125883/12, dated Mar. 6, 2019.
Demuner et al., "Ultra low intensity refining of eucalyptus pulps." Scientific and technical advances in refining and mechanical pulping 2005.
Joy et al., "Ultra-Low intensity refining of short fibered pulps." African Pulp and Paper Week 2004 retrieved from URL:< https://www.tappsa.eo.za/archive2/APPW_2004/Title2004/Ultra-low_intensity_refining/ultra-low_intensity_refining.html >.
Office Action issued in corresponding European Patent No. 17195921 dated Apr. 17, 2019.
Carvalho, et al., "A Comparative Study for Two Automated Techniques for Measuring Fiber Length," *Tappi Journal, Technical Association of the Pulp & Paper Industry*, 80(2): 137-142, 1997.
International Preliminary Report on Patentability issued in International Patent Application No. PCT/US2013/055971, dated Feb. 24, 2015.
International Search Report and Written Opinion issued in International Patent Application No. PCT/US2013/055971, dated Oct. 24, 2013.
Office Action issued in corresponding Chinese Patent Application No. 201810081469.0, dated Jan. 21, 2020.
Pala et al., "Refining and enzymatic treatment of secondary fibres for paperboard production: Cyberflex measurements of fibre flexibility" COST E20—Wood Fibre Cell Wall Structure 2001, 4 pages.
Brazilian Search Report Issued in Corresponding Brazilian Patent Application No. BR112015003819-0, dated Sep. 9, 2019.
Office Action Issued in Corresponding Korean Patent Application No. 10-2015-7006955, dated May 29, 2020.
Office Communication issued in U.S. Appl. No. 15/787,147, dated Nov. 23, 2020.

* cited by examiner

SURFACE ENHANCED PULP FIBERS, METHODS OF MAKING SURFACE ENHANCED PULP FIBERS, PRODUCTS INCORPORATING SURFACE ENHANCED PULP FIBERS, AND METHODS OF MAKING PRODUCTS INCORPORATING SURFACE ENHANCED PULP FIBERS

CROSS-REFERENCE TO RELATED APPLICATION

This application is a Continuation of U.S. patent application Ser. No. 13/836,760, filed on Mar. 15, 2013, claims priority to U.S. Provisional Patent Application Ser. No. 61/692,880, filed on Aug. 24, 2012, which is hereby incorporated by reference as though fully set forth herein.

FIELD

The present invention relates generally to surface enhanced pulp fibers that can be used, for example, in pulp, paper, paperboard, biofiber composites (e.g., fiber cement board, fiber reinforced plastics, etc.), absorbent products (e.g., fluff pulp, hydrogels, etc.), specialty chemicals derived from cellulose (e.g., cellulose acetate, carboxymethyl cellulose (CMC), etc.), and other products. The present invention also relates to methods of making surface enhanced pulp fibers, products incorporating surface enhanced pulp fibers, and methods of making products incorporating surface enhanced pulp fibers.

BACKGROUND

Pulp fibers, such as wood pulp fibers, are used in a variety of products including, for example, pulp, paper, paperboard, biofiber composites (e.g., fiber cement board, fiber reinforced plastics, etc.), absorbent products (e.g., fluff pulp, hydrogels, etc.), specialty chemicals derived from cellulose (e.g., cellulose acetate, carboxymethyl cellulose (CMC), etc.), and other products. The pulp fibers can be obtained from a variety of wood types including hardwoods (e.g., oak, gum, maple, poplar, eucalyptus, aspen, birch, etc.), softwoods (e.g., spruce, pine, fir, hemlock, southern pine, redwood, etc.), and non-woods (e.g., kenaf, hemp, straws, bagasse, etc.). The properties of the pulp fibers can impact the properties of the ultimate end product, such as paper, the properties of intermediate products, and the performance of the manufacturing processes used to make the products (e.g., papermachine productivity and cost of manufacturing). The pulp fibers can be processed in a number of ways to achieve different properties. In some existing processes, some pulp fibers are refined prior to incorporation into an end product. Depending on the refining conditions, the refining process can cause significant reductions in length of the fibers, can generate, for certain applications, undesirable amounts of fines, and can otherwise impact the fibers in a manner that can adversely affect the end product, an intermediate product, and/or the manufacturing process. For example, the generation of fines can be disadvantageous in some applications because fines can slow drainage, increase water retention, and increase wet-end chemical consumption in papermaking which may be undesirable in some processes and applications.

Fibers in wood pulp typically have a length weighted average fiber length ranging between 0.5 and 3.0 millimeters prior to processing into pulp, paper, paperboard, biofiber composites (e.g., fiber cement board, fiber reinforced plastics, etc.), absorbent products (e.g., fluff pulps, hydrogels, etc.), specialty chemicals derived from cellulose (e.g., cellulose acetate, carboxymethyl cellulose (CMC), etc.) and similar products. Refining and other processing steps can shorten the length of the pulp fibers. In conventional refining techniques, fibers are passed usually only once, but generally no more than 2-3 times, through a refiner using a relatively low energy (for example, about 20-80 kWh/ton for hardwood fibers) and using a specific edge load of about 0.4-0.8 Ws/m for hardwood fibers to produce typical fine paper.

SUMMARY

The present invention relates generally to various embodiments of surface enhanced pulp fibers, methods for producing, applying, and delivering surface enhanced pulp fibers, products incorporating surface enhanced pulp fibers, and methods for producing, applying, and delivering products incorporating surface enhanced pulp fibers, and various others described herein.

In various embodiments, surface enhanced pulp fibers of the present invention have significantly higher surface areas without significant reductions in fiber lengths, as compared to conventional refined fibers, and without a substantial amount of fines being generated during fibrillation. In one embodiment, a plurality of surface enhanced pulp fibers has a length weighted average fiber length of at least about 0.3 millimeters and an average hydrodynamic specific surface area of at least about 10 square meters per gram, wherein the number of surface enhanced pulp fibers is at least 12,000 fibers/milligram on an oven-dry basis. The fibers have a length weighted average fiber length of at least about 0.35 millimeters in further embodiments, and at least about 0.4 millimeters in others. In some embodiments, the fibers have an average hydrodynamic specific surface area of at least about 12 square meters per gram. A plurality of surface enhanced pulp fibers, in some embodiments, have a length weighted fines value of less than 40% when fibers having a length of 0.2 millimeters or less are classified as fines. In further embodiments, the fibers have a length weighted fines value of less than 22%.

In some embodiments of the present invention, a plurality of surface enhanced pulp fibers have a length weighted average length that is at least 60% of the length weighted average length of the fibers prior to fibrillation and an average hydrodynamic specific surface area that is at least 4 times greater than the average specific surface area of the fibers prior to fibrillation. The plurality of surface enhanced pulp fibers, in some further embodiments have a length weighted average length that is at least 70% of the length weighted average length of the fibers prior to fibrillation. The plurality of surface enhanced pulp fibers, in some further embodiments, have an average hydrodynamic specific surface area that is at least 8 times greater than the average hydrodynamic specific surface area of the fibers prior to fibrillation. The plurality of surface enhanced pulp fibers have a length weighted average fiber length ($L_w$) of at least about 0.3 millimeters and an average hydrodynamic specific surface area of at least about 10 square meters per gram, wherein the number of surface enhanced pulp fibers is at least 12,000 fibers/milligram on an oven-dry basis, in some further embodiments. The plurality of surface enhanced pulp fibers, in some further embodiments, have a length weighted average fiber length ($L_w$) of at least about 0.4 millimeters and an average hydrodynamic specific surface area of at least about 12 square meters per gram, wherein the number of surface enhanced pulp fibers is at least 12,000 fibers/milligram on an oven-dry basis. In some embodiments, the plurality of surface enhanced pulp fibers have a length weighted fines value of less than 40% when fibers having a length of 0.2 millimeters or less are classified as fines. The plurality of surface enhanced pulp fibers have a length weighted fines value of less than 22% in some embodiments.

The plurality of surface enhanced pulp fibers can originate from hardwoods or softwoods in various embodiments.

The present invention also relates to articles of manufacture incorporating a plurality of surface enhanced pulp fibers according to various embodiments of the present invention. Examples of such articles of manufacture include, without limitation, paper products, a paperboard products, fiber cement boards, fiber reinforced plastics, fluff pulps, and hydrogels.

The present invention also relates to articles of manufacture formed from a plurality of surface enhanced pulp fibers according to various embodiments of the present invention. Examples of such articles of manufacture include, without limitation, cellulose acetate products and carboxymethyl cellulose products.

The present invention also relates to various methods for producing surface enhanced pulp fibers. In some embodiments, a method for producing surface enhanced pulp fibers comprises introducing unrefined pulp fibers in a mechanical refiner comprising a pair of refiner plates, wherein the plates have a bar width of 1.3 millimeters or less and a groove width of 2.5 millimeters or less, and refining the fibers until an energy consumption of at least 300 kWh/ton for the refiner is reached to produce surface enhanced pulp fibers. The plates have a bar width of 1.0 millimeters or less and a groove width of 1.6 millimeters or less in some embodiments. In some embodiments, the fibers are refined until an energy consumption of at least 450 kWh/ton for the refiner is reached, or until an energy consumption of at least 650 kWh/ton for the refiner is reached in further embodiments. In some embodiments, the fibers are refined until an energy consumption between about 300 kWh/ton and about 650 kWh/ton for the refiner is reached. The fibers, in some further embodiments, are refined until an energy consumption between about 450 kWh/ton and about 650 kWh/ton for the refiner is reached. The refiner operates at a specific edge load between about 0.1 and about 0.3 Ws/m in some embodiments, and at a specific edge load between about 0.1 and about 0.2 Ws/m in other embodiments.

In some embodiments, the fibers can be recirculated through the refiner. For example, in some embodiments, the fibers are recirculated through the refiner a plurality of times until an energy consumption of at least 300 kWh/ton is reached. The fibers, in some embodiments, are recirculated through the refiner at least three times. In some embodiments, a portion of the fibers are removed and another portion are recirculated. Some embodiments of methods of the present invention thus further comprise continuously removing a plurality of fibers from the mechanical refiner, wherein a portion of the removed fibers are surface enhanced pulp fibers, and recirculating greater than about 80% of the removed fibers back to the mechanical refiner for further refining.

Some embodiments of methods of the present invention utilize two or more mechanical refiners. In some such embodiments, a method for producing surface enhanced pulp fibers comprises introducing unrefined pulp fibers in a first mechanical refiner comprising a pair of refiner plates, wherein the plates have a bar width of 1.3 millimeters or less and a groove width of 2.5 millimeters or less, refining the fibers in the first mechanical refiner, transporting the fibers to at least one additional mechanical refiner comprising a pair of refiner plates, wherein the plates have a bar width of 1.3 millimeters or less and a groove width of 2.5 millimeters or less, and refining the fibers in the at least one additional mechanical refiner until a total energy consumption of at least 300 kWh/ton for the refiners is reached to produce surface enhanced pulp fibers. The fibers are refined in the first mechanical refiner by recirculating at least a portion of the fibers through the first mechanical refiner a plurality of times, in some embodiments. In some embodiments, the fibers are recirculated through an additional mechanical refiner a plurality of times. The refiner plates in the first mechanical refiner, in some further embodiments, have a bar width of greater than 1.0 millimeters and a groove width of greater or equal to 2.0 millimeters, and the refiner plates in the at least one additional mechanical refiner have a bar width of 1.0 millimeters or less and a groove width of 1.6 millimeters or less.

Methods for producing surface enhanced pulp fibers, in some embodiments, comprise introducing unrefined pulp fibers in a mechanical refiner comprising a pair of refiner plates, wherein the plates have a bar width of 1.0 millimeters or less and a groove width of 2.0 millimeters or less, refining the fibers, continuously removing a plurality of fibers from the mechanical refiner, wherein a portion of the removed fibers are surface enhanced pulp fibers, and recirculating greater than about 80% of the removed fibers back to the mechanical refiner for further refining.

The surface enhanced pulp fibers produced by methods of the present invention, in some embodiments, can possess one or more of the properties described herein. For example, according to some embodiments, such surface enhanced pulp fibers have a length weighted average length that is at least 60% of the length weighted average length of the unrefined pulp fibers and an average hydrodynamic specific surface area that is at least 4 times greater than the average specific surface area of the unrefined pulp fibers.

These and other embodiments are presented in greater detail in the detailed description which follows.

DETAILED DESCRIPTION

Figure 1:
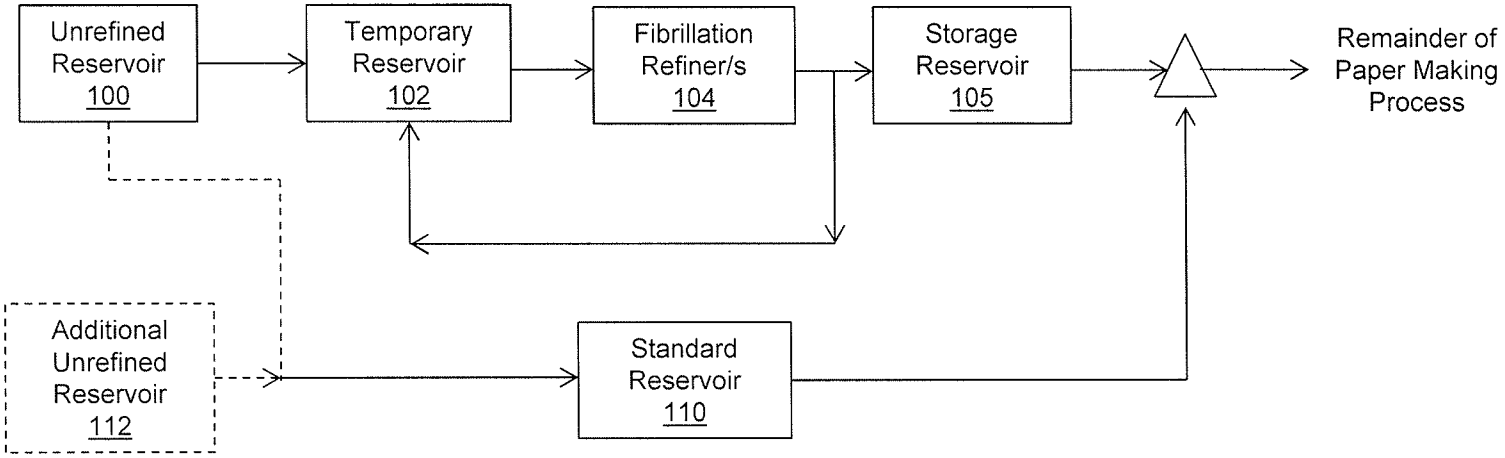
FIG. 1 is a block diagram illustrating a system for making a paper product according to one non-limiting embodiment of the present invention.

Embodiments of the present invention relate generally to surface enhanced pulp fibers, methods for producing, applying, and delivering surface enhanced pulp, products incorporating surface enhanced pulp fibers, and methods for producing, applying, and delivering products incorporating surface enhanced pulp fibers, and others as will be evident from the following description. The surface enhanced pulp fibers are fibrillated to an extent that provides desirable properties as set forth below and may be characterized as being highly fibrillated. In various embodiments, surface enhanced pulp fibers of the present invention have significantly higher surface areas without significant reductions in fiber lengths, as compared to conventional refined fibers, and without a substantial amount of fines being generated during fibrillation. Such surface enhanced pulp fibers can be useful in the production of pulp, paper, and other products as described herein.

The pulp fibers that can be surface enhanced according to embodiments of the present invention can originate from a variety of wood types, including hardwood and softwood. Non-limiting examples of hardwood pulp fibers that can be used in some embodiments of the present invention include, without limitation, oak, gum, maple, poplar, *eucalyptus*, aspen, birch, and others known to those of skill in the art. Non-limiting examples of softwood pulp fibers that can be used in some embodiments of the present invention include, without limitation, spruce, pine, fir, hemlock, southern pine, redwood, and others known to those of skill in the art. The pulp fibers may be obtained from a chemical source (e.g., a Kraft process, a sulfite process, a soda pulping process, etc.), a mechanical source, (e.g., a thermomechanical process (TMP), a bleached chemi-thermomechanical process (BCTMP), etc.), or combinations thereof. The pulp fibers can also originate from non-wood fibers such as linen, cotton, bagasse, hemp, straw, kenaf, etc. The pulp fibers can be bleached, partially bleached, or unbleached with varying degrees of lignin content and other impurities. In some embodiments, the pulp fibers can be recycled fibers or post-consumer fibers.

Surface enhanced pulp fibers according to various embodiments of the present invention can be characterized according to various properties and combinations of properties including, for example, length, specific surface area, change in length, change in specific surface area, surface properties (e.g., surface activity, surface energy, etc.), percentage of fines, drainage properties (e.g., Schopper-Riegler), crill measurement (fibrillation), water absorption properties (e.g., water retention value, wicking rate, etc.), and various combinations thereof. While the following description may not specifically identify each of the various combinations of properties, it should be understood that different embodiments of surface enhanced pulp fibers may possess one, more than one, or all of the properties described herein.

Some embodiments of the present invention relate to a plurality of surface enhanced pulp fibers. In some embodiments, the plurality of surface enhanced pulp fibers have a length weighted average fiber length of at least about 0.3 millimeters, preferably at least about 0.35 millimeters, with a length of about 0.4 millimeters being most preferred, wherein the number of surface enhanced pulp fibers is at least 12,000/milligram on an oven-dry basis. As used herein, "oven-dry basis" means that the sample is dried in an oven set at 105.degree. C. for 24 hours. In general, the longer the length of the fibers, the greater the strength of the fibers and the resulting product incorporating such fibers. Surface enhanced pulp fibers of such embodiments can be useful, for example, in papermaking applications. As used herein, length weighted average length is measured using a LDA02 Fiber Quality Analyzer or a LDA96 Fiber Quality Analyzer, each of which are from OpTest Equipment, Inc. of Hawkesbury, Ontario, Canada, and in accordance with the appropriate procedures specified in the manual accompanying the Fiber Quality Analyzer. As used herein, length weighted average length ($L_w$) is calculated according to the formula:

$$L_w = \frac{\sum n_i L_i^2}{\sum n_i L_i}$$

wherein i refers to the category (or bin) number (e.g., 1, 2, . . . N), $n_i$ refers to the fiber count in the $i^{th}$ category, and $L_i$ refers to contour length—histogram class center length in the $i^{th}$ category.

As noted above, one aspect of surface enhanced pulp fibers of the present invention is the preservation of the lengths of the fibers following fibrillation. In some embodiments, a plurality of surface enhanced pulp fibers can have a length weighted average length that is at least 60% of the length weighted average length of the fibers prior to fibrillation. A plurality of surface enhanced pulp fibers, according to some embodiments, can have a length weighted average length that is at least 70% of the length weighted average length of the fibers prior to fibrillation. In determining the percent length preservation, the length weighted average length of a plurality of fibers can be measured (as described above) both before and after fibrillation and the values can be compared using the following formula:

$$\frac{L_w(\text{before}) - L_w(\text{after})}{L_w(\text{before})}$$

Surface enhanced pulp fibers of the present invention advantageously have large hydrodynamic specific surface areas which can be useful in some applications, such as papermaking. In some embodiments, the present invention relates to a plurality of surface enhanced pulp fibers wherein the fibers have an average hydrodynamic specific surface area of at least about 10 square meters per gram, and more preferably at least about 12 square meters per gram. For illustrative purposes, a typical unrefined papermaking fiber would have a hydrodynamic specific surface area of 2 m.sup.2/g. As used herein, hydrodynamic specific surface area is measured pursuant to the procedure specified in *Characterizing the Drainage Resistance of Pulp and Microfibrillar Suspensions using Hydrodynamic Flow Measurements,* N. Lavrykova-Marrain and B. Ramarao, TAPPI's PaperCon 2012 Conference, which is hereby incorporated by reference.

One advantage of the present invention is that the hydrodynamic specific surface areas of the surface enhanced pulp fibers are significantly greater than that of the fibers prior to fibrillation. In some embodiments, a plurality of surface enhanced pulp fibers can have an average hydrodynamic specific surface area that is at least 4 times greater than the average specific surface area of the fibers prior to fibrillation, preferably at least 6 times greater than the average specific surface area of the fibers prior to fibrillation, and most preferably at least 8 times greater than the average specific surface area of the fibers prior to fibrillation. Surface enhanced pulp fibers of such embodiments can be useful, for example, in papermaking applications. In general, hydrodynamic specific surface area is a good indicator of surface activity, such that surface enhanced pulp fibers of the present invention, in some embodiments, can be expected to have good binding and water retention properties and can be expected to perform well in reinforcement applications.

As noted above, in some embodiments, surface enhanced pulp fibers of the present invention advantageously have increased hydrodynamic specific surface areas while preserving fiber lengths. Increasing the hydrodynamic specific surface area can have a number of advantages depending on the use including, without limitation, providing increased fiber bonding, absorbing water or other materials, retention of organics, higher surface energy, and others.

Embodiments of the present invention relate to a plurality of surface enhanced pulp fibers, wherein the plurality of surface enhanced pulp fibers have a length weighted average fiber length of at least about 0.3 millimeters and an average hydrodynamic specific surface area of at least about 10 square meters per gram, wherein the number of surface enhanced pulp fibers is at least 12,000/milligram on an oven-dry basis. A plurality of surface enhanced pulp fibers, in preferred embodiments, have a length weighted average fiber length of at least about 0.35 millimeters and an average hydrodynamic specific surface area of at least about 12 square meters per gram, wherein the number of surface enhanced pulp fibers is at least 12,000/milligram on an oven-dry basis. In a most preferred embodiment, a plurality of surface enhanced pulp fibers have a length weighted average fiber length of at least about 0.4 millimeters and an average hydrodynamic specific surface area of at least about 12 square meters per gram, wherein the number of surface enhanced pulp fibers is at least 12,000/milligram on an oven-dry basis. Surface enhanced pulp fibers of such embodiments can be useful, for example, in papermaking applications.

In the refinement of pulp fibers to provide surface enhanced pulp fibers of the present invention, some embodiments preferably minimize the generation of fines. As used herein, the term "fines" is used to refer to pulp fibers having a length of 0.2 millimeters or less. In some embodiments, surface enhanced pulp fibers have a length weighted fines value of less than 40%, more preferably less than 22%, with less than 20% being most preferred. Surface enhanced pulp fibers of such embodiments can be useful, for example, in papermaking applications. As used herein, "length weighted fines value" is measured using a LDA02 Fiber Quality Analyzer or a LDA96 Fiber Quality Analyzer, each of which are from OpTest Equipment, Inc. of Hawkesbury, Ontario, Canada, and in accordance with the appropriate procedures specified in the manual accompanying the Fiber Quality Analyzer. As used herein, the percentage of length weighted fines is calculated according to the formula:

$$\%\text{ of length weighted fines} = 100 \times \frac{\sum n_i L_i}{L_T}$$

wherein n refers to the number of fibers having a length of less than 0.2 millimeters, $L_i$ refers to the fines class midpoint length, and $L_T$ refers to total fiber length.

Surface enhanced pulp fibers of the present invention simultaneously offer the advantages of preservation of length and relatively high specific surface area without, in preferred embodiments, the detriment of the generation of a large number of fines. Further, a plurality of surface enhanced pulp fibers, according to various embodiments, can simultaneously possess one or more of the other above-referenced properties (e.g., length weighted average fiber length, change in average hydrodynamic specific surface area, and/or surface activity properties) while also having a relatively low percentage of fines. Such fibers, in some embodiments, can minimize the negative effects on drainage while also retaining or improving the strength of products in which they are incorporated.

Other advantageous properties of surface enhanced pulp fibers can be characterized when the fibers are processed into other products and will be described below following a description of methods of making the surface enhanced pulp fibers.

Embodiments of the present invention also relate to methods for producing surface enhanced pulp fibers. The refining techniques used in methods of the present invention can advantageously preserve the lengths of the fibers while likewise increasing the amount of surface area. In preferred embodiments, such methods also minimize the amount of fines, and/or improve the strength of products (e.g., tensile strength, scott bond strength, wet-web strength of a paper product) incorporating the surface enhanced pulp fibers in some embodiments.

In one embodiment, a method for producing surface enhanced pulp fibers comprises introducing unrefined pulp fibers in a mechanical refiner comprising a pair of refiner plates, wherein the plates have a bar width of 1.3 millimeters or less and a groove width of 2.5 millimeters or less, and refining the fibers until an energy consumption of at least 300 kWh/ton for the refiner is reached to produce surface enhanced pulp fibers. Persons of ordinary skill in the art are familiar with the dimensions of bar width and groove width in connection with refiner plates. To the extent additional information is sought, reference is made to Christopher J. Biermann, *Handbook of Pulping and Papermaking* (2d Ed. 1996) at p. 145, which is hereby incorporated by reference. The plates, in a preferred embodiment, have a bar width of 1.0 millimeters or less and a groove width of 1.6 millimeters or less, and the fibers can be refined until an energy consumption of at least 300 kWh/ton for the refiner is reached to produce surface enhanced pulp fibers. In a most preferred embodiment, the plates have a bar width of 1.0 millimeters or less and a groove width of 1.3 millimeters or less, and the fibers can be refined until an energy consumption of at least 300 kWh/ton for the refiner is reached to produce surface enhanced pulp fibers. As used herein and as understood by those of ordinary skill in the art, the references to energy consumption or refining energy herein utilize units of kWh/ton with the understanding that "/ton" or "per ton" refers to ton of pulp passing through the refiner on a dry basis. In some embodiments, the fibers are refined until an energy consumption of at least 650 kWh/ton for the refiner is reached. The plurality of fibers can be refined until they possess one or more of the properties described herein related to surface enhanced pulp fibers of the present invention. As described in more detail below, persons of skill in the art will recognize that refining energies significantly greater than 300 kWh/ton may be required for certain types of wood fibers and that the amount of refining energy needed to impart the desired properties to the pulp fibers may also vary.

In one embodiment, unrefined pulp fibers are introduced in a mechanical refiner comprising a pair of refiner plates or a series of refiners. The unrefined pulp fibers can include any of the pulp fibers described herein, such as, for example, hardwood pulp fibers or softwood pulp fibers or non-wood pulp fibers, from a variety of processes described herein (e.g., mechanical, chemical, etc.). In addition, the unrefined pulp fibers or pulp fiber source can be provided in a baled or slushed condition. For example, in one embodiment, a baled pulp fiber source can comprise between about 7 and about 11% water and between about 89 and about 93% solids. Likewise, for example, a slush supply of pulp fibers can comprise about 95% water and about 5% solids in one embodiment. In some embodiments, the pulp fiber source has not been dried on a pulp dryer.

Non-limiting examples of refiners that can be used to produce surface enhanced pulp fibers in accordance with some embodiments of the present invention include double disk refiners, conical refiners, single disk refiners, multi-disk refiners or conical and disk(s) refiners in combination. Non-limiting examples of double disk refiners include Beloit DD 3000, Beloit DD 4000 or Andritz DO refiners. Non-limiting example of a conical refiner are Sunds JC01, Sunds JC 02 and Sunds JC03 refiners.

The design of the refining plates as well as the operating conditions are important in producing some embodiments of surface enhanced pulp fibers. The bar width, groove width, and groove depth are refiner plate parameters that are used to characterize the refiner plates. In general, refining plates for use in various embodiments of the present invention can be characterized as fine grooved. Such plates can have a bar width of 1.3 millimeters or less and a groove width of 2.5 millimeters or less. Such plates, in some embodiments, can have a bar width of 1.3 millimeters or less and a groove width of 1.6 millimeters or less. In some embodiments, such plates can have a bar width of 1.0 millimeters or less and a groove width of 1.6 millimeters or less. Such plates, in some embodiments, can have a bar width of 1.0 millimeters or less and a groove width of 1.3 millimeters or less. Refining plates having a bar width of 1.0 millimeters or less and a groove width of 1.6 millimeters or less may also be referred to as ultrafine refining plates. Such plates are available under the FINEBAR® brand from Aikawa Fiber Technologies (AFT). Under the appropriate operating conditions, such fine grooved plates can increase the number of fibrils on a pulp fiber (i.e., increase the fibrillation) while preserving fiber length and minimizing the production of fines. Conventional plates (e.g., bar widths of greater than 1.3 millimeters and/or groove widths of greater than 2.0 millimeters) and/or improper operating conditions can significantly enhance fiber cutting in the pulp fibers and/or generate an undesirable level of fines.

The operating conditions of the refiner can also be important in the production of some embodiments of surface enhanced pulp fibers. In some embodiments, the surface enhanced pulp fibers can be produced by recirculating pulp fibers which were originally unrefined through the refiner(s) until an energy consumption of at least about 300 kWh/ton is reached. The surface enhanced pulp fibers can be produced by recirculating pulp fibers which were originally unrefined through the refiner(s) until an energy consumption of at least about 450 kWh/ton is reached in some embodiments. In some embodiments the fibers can be recirculated in the refiner until an energy consumption of between about 450 and about 650 kWh/ton is reached. In some embodiments, the refiner can operate at a specific edge load between about 0.1 and about 0.3 Ws/m. The refiner can operate at a specific edge load of between about 0.15 and about 0.2 Ws/m in other embodiments. In some embodiments, an energy consumption of between about 450 and about 650 kWh/ton is reached using a specific edge load of between about 0.1 Ws/m and about 0.2 Ws/m to produce the surface enhanced pulp fibers. Specific edge load (or SEL) is a term understood to those of ordinary skill in the art to refer to the quotient of net applied power divided by the product of rotating speed and edge length. SEL is used to characterize the intensity of refining and is expressed as Watt-second/meter (Ws/m).

As described in more detail below, persons of skill in the art will recognize that refining energies significantly greater than 400 kWh/ton may be required for certain types of wood fibers and that the amount of refining energy needed to impart the desired properties to the pulp fibers may also vary. For example, Southern mixed hardwood fibers (e.g., oak, gum, elm, etc.) may require refining energies of between about 450-650 kWh/ton. In contrast, Northern hardwood fibers (e.g., maple, birch, aspen, beech, etc.) may require refining energies of between about 350 and about 500 kWh/ton as Northern hardwood fibers are less coarse than Southern hardwood fibers. Similarly, Southern softwood fibers (e.g., pine) may require even greater amounts of refining energy. For example, in some embodiments, refining Southern softwood fibers according to some embodiments may be significantly higher (e.g., at least 1000 kWh/ton).

The refining energy can also be provided in a number of ways depending on the amount of refining energy to be provided in a single pass through a refiner and the number of passes desired. In some embodiments, the refiners used in some methods may operate at lower refining energies per pass (e.g., 100 kWh/ton/pass or less) such that multiple passes or multiple refiners are needed to provide the specified refining energy. For example, in some embodiments, a single refiner can operate at 50 kWh/ton/pass, and the pulp fibers can be recirculated through the refiner for a total of 9 passes to provide 450 kWh/ton of refining. In some embodiments, multiple refiners can be provided in series to impart of refining energy.

In some embodiments where pulp fibers reach the desired refining energy by recirculating the fibers through a single refiner, the pulp fibers can be circulated at least two times through the refiner to obtain the desired degree of fibrillation. In some embodiments, the pulp fibers can be circulated between about 6 and about 25 times through the refiner to obtain the desired degree of fibrillation. The pulp fibers can be fibrillated in a single refiner by recirculation in a batch process.

In some embodiments, the pulp fibers can be fibrillated in a single refiner using a continuous process. For example, such a method can comprise, in some embodiments, continuously removing a plurality of fibers from the refiner, wherein a portion of the removed fibers are surface enhanced pulp fibers, and recirculating greater than about 80% of the removed fibers back to the mechanical refiner for further refining In some embodiments, greater than about 90% of the removed fibers can be recirculated back to the mechanical refiner for further refining. In such embodiments, the amount of unrefined fibers introduced to the refiner and the amount of fibers removed from the fiber without recirculation can be controlled such that a predetermined amount of fibers continually pass through the refiner. Put another way, because some amount of fibers are removed from the recirculation loop associated with the refiner, a corresponding amount of unrefined fibers should be added to the refiner in order to maintain a desired level of fibers circulating through the refiner. To facilitate the production of surface enhanced pulp fibers having particular properties (e.g., length weighted average fiber length, hydrodynamic specific surface area, etc.), the refining intensity (i.e., specific edge load) per pass will need to be reduced during the process as the number of passes increases.

In other embodiments, two or more refiners can be arranged in series to circulate the pulp fibers to obtain the desired degree of fibrillation. It should be appreciated that a variety of multi-refiner arrangements can be used to produce surface enhanced pulp fibers according to the present invention. For example, in some embodiments, multiple refiners can be arranged in series that utilize the same refining plates and operate under the same refining parameters (e.g., refining energy per pass, specific edge load, etc.). In some such embodiments, the fibers may pass through one of the refiners only once and/or through another of the refiners multiple times.

In one exemplary embodiment, a method for producing surface enhanced pulp fibers comprises introducing unrefined pulp fibers in a first mechanical refiner comprising a pair of refiner plates, wherein the plates have a bar width of 1.3 millimeters or less and a groove width of 2.5 millimeters or less, refining the fibers in the first mechanical refiner, transporting the fibers to at least one additional mechanical refiner comprising a pair of refiner plates, wherein the plates have a bar width of 1.3 millimeters or less and a groove width of 2.5 millimeters or less, and refining the fibers in the at least one additional mechanical refiner until a total energy consumption of at least 300 kWh/ton for the refiners is reached to produce surface enhanced pulp fibers. In some embodiments, the fibers can be recirculated through the first mechanical refiner a plurality of times. The fibers can be recirculated through an additional mechanical refiner a plurality of times in some embodiments. In some embodiments, the fibers can be recirculated through two or more of the mechanical refiners a plurality of times.

In some embodiments of methods for producing surface enhanced pulp fibers utilizing a plurality of refiners, a first mechanical refiner can be used to provide a relatively less fine, initial refining step and one or more subsequent refiners can be used to provide surface enhanced pulp fibers according to the embodiments of the present invention. For example, the first mechanical refiner in such embodiments can utilize conventional refining plates (e.g., bar width of greater than 1.0 mm and groove width of 1.6 mm or greater) and operate under conventional refining conditions (e.g., specific edge load of 0.25 Ws/m) to provide an initial, relatively less fine fibrillation to the fibers. In one embodiment, the amount of refining energy applied in the first mechanical refiner can be about 100 kWh/ton or less. After the first mechanical refiner, the fibers can then be provided to one or more subsequent refiners that utilizing ultrafine refining plates (e.g., bar width of 1.0 mm or less and groove width of 1.6 mm or less) and operate under conditions (e.g., specific edge load of 0.13 Ws/m) sufficient to produce surface enhanced pulp fibers in accordance with some embodiments of the present invention. In some embodiments, for example, the cutting edge length (CEL) can increase between refinement using conventional refining plates and refinement using ultrafine refining plates depending on the differences between the refining plates. Cutting Edge Length (or CEL) is the product of bar edge length and the rotational speed As set forth above, the fibers can pass through or recirculate through the refiners multiple times to achieve the desired refining energy and/or multiple refiners can be used to achieve the desired refining energy.

In one exemplary embodiment, a method for producing surface enhanced pulp fibers comprises introducing unrefined pulp fibers in a first mechanical refiner comprising a pair of refiner plates, wherein the plates have a bar width of greater than 1.0 millimeters and a groove width of 2.0 millimeters or greater. Refining the fibers in the first mechanical refiner can be used to provide a relatively less fine, initial refining to the fibers in some embodiments. After refining the fibers in the first mechanical refiner, the fibers are transported to at least one additional mechanical refiner comprising a pair of refiner plates, wherein the plates have a bar width of 1.0 millimeters or less and a groove width of 1.6 millimeters or less. In the one or more additional mechanical refiners, the fibers can be refined until a total energy consumption of at least 300 kWh/ton for the refiners is reached to produce surface enhanced pulp fibers. In some embodiments, the fibers are recirculated through the first mechanical refiner a plurality of times. The fibers are recirculated through the one or more additional mechanical refiner a plurality of times, in some embodiments.

With regard to the various methods described herein, the pulp fibers can be refined at low consistency (e.g., between 3 and 5%) in some embodiments. Persons of ordinary skill in the art will understand consistency to reference the ratio of oven dried fibers to the combined amount of oven dried fibers and water. In other words, a consistency of 3% would reflect for example, the presence of 3 grams of oven dried fibers in 100 milliliters of pulp suspension.

Other parameters associated with operating refiners to produce surface enhanced pulp fibers can readily be determined using techniques known to those of skill in the art. Similarly, persons of ordinary skill in the art can adjust the various parameters (e.g., total refining energy, refining energy per pass, number of passes, number and type of refiners, specific edge load, etc.) to produce surface enhanced pulp fibers of the present invention. For example, the refining intensity, or refining energy applied to the fibers per pass utilizing a multi-pass system, should be gradually reduced as the number of passes through a refiner increases in order to get surface enhanced pulp fibers having desirable properties in some embodiments.

Various embodiments of surface enhanced pulp fibers of the present invention can be incorporated into a variety of end products. Some embodiments of surface enhanced pulp fibers of the present invention can impart favorable properties on the end products in which they are incorporated in some embodiments. Non-limiting examples of such products include pulp, paper, paperboard, biofiber composites (e.g., fiber cement board, fiber reinforced plastics, etc.), absorbent products (e.g., fluff pulp, hydrogels, etc.), specialty chemicals derived from cellulose (e.g., cellulose acetate, carboxymethyl cellulose (CMC), etc.), and other products. Persons of skill in the art can identify other products in which the surface enhanced pulp fibers might be incorporated based particularly on the properties of the fibers. For example, by increasing the specific surface areas of surface enhanced pulp fibers (and thereby the surface activity), utilization of surface enhanced pulp fibers can advantageously increase the strength properties (e.g., dry tensile strength) of some end products while using approximately the same amount of total fibers and/or provide comparable strength properties in an end product while utilizing fewer fibers on a weight basis in the end product in some embodiments.

In addition to physical properties which are discussed further below, the use of surface enhanced pulp fibers according to some embodiments of the present invention can have certain manufacturing advantages and/or cost savings in certain applications. For example, in some embodiments, incorporating a plurality of surface enhanced pulp fibers according to the present invention into a paper product can lower the total cost of fibers in the furnish (i.e., by substituting high cost fibers with lower cost surface enhanced pulp fibers). For example, longer softwood fibers typically cost more than shorter hardwood fibers. In some embodiments, a paper product incorporating at least 2 weight percent surface enhanced pulp fibers according to the present invention can result in the removal of about 5% of the higher cost softwood fibers while still maintaining the paper strength, maintaining runnability of the paper machine, maintaining process performance, and improving print performance. A paper product incorporating between about 2 and about 8 weight percent surface enhanced pulp fibers according to some embodiments of the present invention can result in removal of about 5% and about 20% of the higher cost softwood fibers while maintaining the paper strength and improving print performance in some embodiments. Incorporating between about 2 and about 8 weight percent surface enhanced pulp fibers according to the present invention can help lower the cost of manufacturing paper significantly when compared to a paper product made in the same manner with substantially no surface enhanced pulp fibers in some embodiments.

One application in which surface enhanced pulp fibers of the present invention can be used, is paper products. In the production of paper products using surface enhanced pulp fibers of the present invention, the amount of surface enhanced pulp fibers used in the production of the papers can be important. For example, and without limitation, using some amount of surface enhanced pulp fibers can have the advantages of increasing the tensile strength and/or increasing the wet web strength of the paper product, while minimizing potential adverse effects such as drainage. In some embodiments, a paper product can comprise greater than about 2 weight percent surface enhanced pulp fibers (based on the total weight of the paper product). A paper product can comprise greater than about 4 weight percent surface enhanced pulp fibers in some embodiments. A paper product, in some embodiments, can comprise less than about 15 weight percent surface enhanced pulp fibers. In some embodiments, a paper product can comprise less than about 10 weight percent surface enhanced pulp fibers. A paper product can comprise between about 2 and about 15 weight percent surface enhanced pulp fibers in some embodiments. In some embodiments, a paper product can comprise between about 4 and about 10 weight percent surface enhanced pulp fibers. In some embodiments, the surface enhanced pulp fibers used in paper products can substantially or entirely comprise hardwood pulp fibers.

In some embodiments, when surface enhanced pulp fibers of the present invention are incorporated into paper products, the relative amount of softwood fibers that can be displaced is between about 1 and about 2.5 times the amount of surface enhanced pulp fibers used (based on the total weight of the paper product), with the balance of the substitution coming from conventionally refined hardwood fibers. In other words, and as one non-limiting example, about 10 weight percent of the conventionally refined softwood fibers can be replaced by about 5 weight percent surface enhanced pulp fibers (assuming a displacement of 2 weight percent of softwood fibers per 1 weight percent of surface enhanced pulp fibers) and about 5 weight percent conventionally refined hardwood fibers. Such substitution can occur, in some embodiments, without compromising the physical properties of the paper products.

With regard to physical properties, surface enhanced pulp fibers according to some embodiments of the present invention can improve the strength of a paper product. For example, incorporating a plurality of surface enhanced pulp fibers according to some embodiments of the present invention into a paper product can improve the strength of the final product. In some embodiments, a paper product incorporating at least 5 weight percent surface enhanced pulp fibers according to the present invention can result in higher wet-web strength and/or dry strength characteristics, can improve runnability of a paper machine at higher speeds, and/or can improve process performance, while also improving production. Incorporating between about 2 and about 10 weight percent surface enhanced pulp fibers according to the present invention can help improve the strength and performance of a paper product significantly when compared to a similar product made in the same manner with substantially no surface enhanced pulp fibers according to the present invention, in some embodiments.

As another example, a paper product incorporating between about 2 and about 8 weight percent surface enhanced pulp fibers according to some embodiments of the present invention, and with about 5 to about 20 weight percent less softwood fibers, can have similar wet web tensile strength to a similar paper product with the softwood fibers and without surface enhanced pulp fibers. A paper product incorporating a plurality of surface enhanced pulp fibers according to the present invention can have a wet web tensile strength of at least 150 meters in some embodiments. In some embodiments, a paper product incorporating at least 5 weight percent surface enhanced pulp fibers, and 10% weight less softwood fibers, according to some embodiments of the present invention, can have a wet web tensile strength (at 30% consistency) of at least 166 meters. Incorporating between about 2 and about 8 weight percent surface enhanced pulp fibers according to the present invention can improve wet web tensile strength of a paper product when compared to a paper product made in the same manner with substantially no surface enhanced pulp fibers, such that some embodiments of paper products incorporating surface enhanced pulp fibers can have desirable wet-web tensile strengths with fewer softwood fibers. In some embodiments, incorporating at least about 2 weight percent surface enhanced pulp fibers of the present invention in a paper product can improve other properties in various embodiments including, without limitation, opacity, porosity, absorbency, tensile energy absorption, scott bond/internal bond and/or print properties (e.g., ink density print mottle, gloss mottle).

As another example, in some embodiments, a paper product incorporating a plurality surface enhanced pulp fibers according to the present invention can have a desirable dry tensile strength. In some embodiments, a paper product incorporating at least 5 weight percent surface enhanced pulp fibers can have a desirable dry tensile strength. A paper product incorporating between about 5 and about 15 weight percent surface enhanced pulp fibers according to the present invention can have a desirable dry tensile strength. In some embodiments, incorporating between about 5 and about 15 weight percent surface enhanced pulp fibers according to the present invention can improve dry tensile strength of a paper product when compared to a paper product made in the same manner with substantially no surface enhanced pulp fibers.

In some embodiments, incorporating at least about 5 weight percent surface enhanced pulp fibers of the present invention can improve other properties in various embodiments including, without limitation, opacity, porosity, absorbency, and/or print properties (e.g., ink density print mottle, gloss mottle, etc.).

In some embodiments of such products incorporating a plurality of surface enhanced pulp fibers, the improvements of certain properties, in some instances, can be proportionally greater than the amount of surface enhanced pulp fibers included. In other words, and as an example, in some embodiments, if a paper product incorporates about 5 weight percent surface enhanced pulp fibers, the corresponding increase in dry tensile strength may be significantly greater than 5%.

In addition to paper products which have been discussed above, in some embodiments, pulp incorporating a plurality of surface enhanced pulp fibers according to the present invention can have improved properties such as, without limitation, improved surface activity or reinforcement potential, higher sheet tensile strength (i.e., improved paper strength) with less total refining energy, improved water absorbency, and/or others.

As another example, in some embodiments, an intermediate pulp and paper product (e.g., fluff pulp, reinforcement pulp for paper grades, market pulp for tissue, market pulp for paper grades, etc.), incorporating between about 1 and about 10 weight percent surface enhanced pulp fibers can provide improved properties. Non-limiting examples of improved properties of intermediate pulp and paper products can include increased wet web tensile strength, a comparable wet web tensile strength, improved absorbency, and/or others.

As another example, in some embodiments, an intermediate paper product (e.g., baled pulp sheets or rolls, etc.), incorporating surface enhanced pulp fibers can provide a disproportionate improvement in final product performance and properties, with at least 1 weight percent surface enhanced pulp fibers being more preferred. In some embodiments, an intermediate paper product can incorporate between 1 weight percent and 10 weight percent surface enhanced pulp fibers. Non-limiting examples of improved properties of such intermediate paper products can include, increased wet web tensile strength, better drainage properties at comparable wet web tensile strength, improved strength at a similar hardwood to softwood ratio, and/or comparable strength at higher hardwood to softwood ratio.

In manufacturing paper products according to some embodiments of the present invention, surface enhanced pulp fibers of the present invention can be provided as a slipstream in a conventional paper manufacturing process. For example, surface enhanced pulp fibers of the present invention can be mixed with a stream of hardwood fibers refined using conventional refining plates and under conventional conditions. The combination stream of hardwood pulp fibers can then be combined with softwood pulp fibers and used to produce paper using conventional techniques.

Other embodiments of the present invention relate to paperboards that comprise a plurality of surface enhanced pulp fibers according to some embodiments of the present invention. Paperboards according to embodiments of the present invention can be manufactured using techniques known to those of skill in the art except incorporating some amount of surface enhanced pulp fibers of the present invention, with at least 2% surface enhanced pulp fibers being more preferred. In some embodiments, paperboards can be manufactured using techniques known to those of skill in the art except utilizing between about 2% and about 3% surface enhanced pulp fibers of the present invention.

Other embodiments of the present invention also relate to bio fiber composites (e.g., fiber cement boards, fiber reinforced plastics, etc.) that includes a plurality of surface enhanced pulp fibers according to some embodiments of the present invention. Fiber cement boards of the present invention can generally be manufactured using techniques known to those of skill in the art except incorporating surface enhanced pulp fibers according to some embodiments of the present invention, at least 3% surface enhanced pulp fibers being more preferred. In some embodiments, fiber cement boards of the present invention can generally be manufactured using techniques known to those of skill in the art except utilizing between about 3% and about 5% surface enhanced pulp fibers of the present invention.

Other embodiments of the present invention also relate to water absorbent materials that comprise a plurality of surface enhanced pulp fibers according to some embodiments of the present invention. Such water absorbent materials can be manufactured using techniques known to those of skill in the art utilizing surface enhanced pulp fibers according to some embodiments of the present invention. Non-limiting examples of such water absorbent materials include, without limitation, fluff pulps and tissue grade pulps.

FIG. 1 illustrates one exemplary embodiment of a system that can be used to make paper products incorporating surface enhanced pulp fibers of the present invention. An unrefined reservoir 100 containing unrefined hardwood fibers, for example in the form of a pulp base, is connected to a temporary reservoir 102, which is connected to a fibrillation refiner 104 in a selective closed circuit connection. As mentioned above, in a particular embodiment, the fibrillation refiner 104 is a refiner that is set up with suitable parameters to produce the surface enhanced pulp fibers described herein. For example, the fibrillation refiner 104 can be a dual disk refiner with pair of refining disks each having a bar width of 1.0 millimeters and a groove width of 1.3 millimeters, and with a specific edge load of about 0.1-0.3 Ws/m. The closed circuit between the temporary reservoir 102 and fibrillation refiner 104 is maintained until the fibers have circulated through the refiner 104 a desired number of times, for example until an energy consumption of about 400-650 kWh/ton is reached.

An exit line extends from the fibrillation refiner 104 to a storage reservoir 105, this line remaining closed until the fibers have circulated through the refiner 104 an adequate number of times. The storage reservoir 105 is in connection with a flow exiting from a conventional refiner 110 set up with conventional parameters to produce conventional refined fibers. In some embodiments, the storage reservoir 105 is not utilized and the fibrillation refiner 104 is in connection with the flow exiting from the conventional refiner 110.

In a particular embodiment, the conventional refiner 110 is also connected to the unrefined reservoir 100, such that a single source of unrefined fibers (e.g., a single source of hardwood fibers) is used in both the refining and fibrillation processes. In another embodiment, a different unrefined reservoir 112 is connected to the conventional refiner 110 to provide the conventional refined fibers. In this case, both reservoirs 100, 112 can include similar or different fibers therein.

It is understood that all the connections between the different elements of the system may include pumps (not shown) or other suitable equipment for forcing the flow therebetween as required, in addition to valves (not shown) or other suitable equipment for selectively closing the connection where required. Also, additional reservoirs (not shown) may be located in between successive elements of the system.

In use and in accordance with a particular embodiment, the unrefined fibers are introduced in a mechanical refining process where a relatively low specified edge load (SEL), for example about 0.1-0.3 Ws/m, is applied thereon, for example through the refining plates described above. In the embodiment shown, this is done by circulating the unrefined fibers from the reservoir 100 to the temporary reservoir 102, and then between the fibrillation refiner 104 and the temporary reservoir 102. The mechanical refining process is continued until a relatively high energy consumption is reached, for example about 450-650 kWh/ton. In the embodiment shown, this is done by recirculating the fibers between the fibrillation refiner 104 and temporary reservoir 102 until the fibers have gone through the refiner 104 "n" times. In one embodiment, n is at least 3, and in some embodiments may be between 6 and 25. "n" can be selected to provide surface enhanced pulp fibers with properties (e.g., length, length weighted average, specific surface area, fines, etc.) for example within the given ranges and/or values described herein.

The surface enhanced pulp fiber flow then exits the fibrillation refiner 104, to the storage reservoir 105. The surface enhanced pulp fiber flow exits the storage reservoir 105 and is then added to a flow of conventional refined fibers having been refined in a conventional refiner 110 to obtain a stock composition for making paper. The proportion between the surface enhanced pulp fibers and the conventional refined fibers in the stock composition may be limited by the maximum proportion of surface enhanced pulp fibers that will allow for adequate properties of the paper produced. In one embodiment, between about 4 and 15% of the fiber content of the stock composition is formed by the surface enhanced pulp fibers (i.e., between about 4 and 15% of the fibers present in the stock composition are surface enhanced pulp fibers). In some embodiments, between about 5 and about 10% of the fibers present in the stock composition are surface enhanced pulp fibers. Other proportions of surface enhanced pulp fibers are described herein and can be used.

The stock composition of refined fibers and surface enhanced pulp fibers can then be delivered to the remainder of a papermaking process where paper can be formed using techniques known to those of skill in the art.

Figure 2:
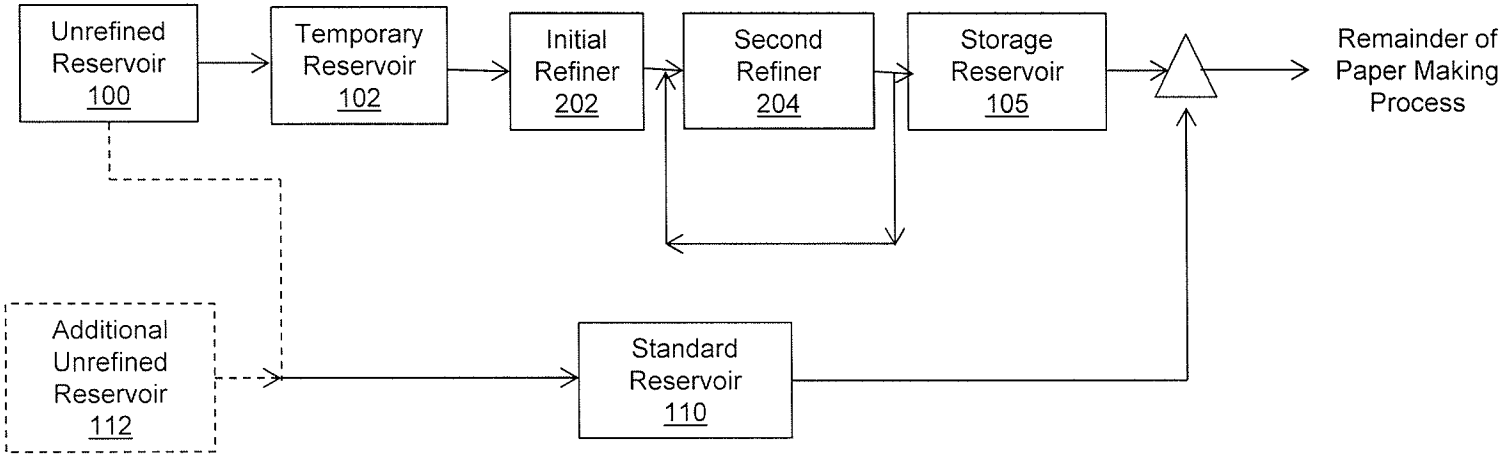
FIG. 2 is a block diagram illustrating a system for making a paper product that includes a second refiner according to one non-limiting embodiment of the present invention.

FIG. 2 illustrates a variation of the exemplary embodiment shown in FIG. 1 in which the fibrillation refiner 104 has been replaced two refiners 202,204 arranged in series. In this embodiment, the initial refiner 202 provides a relatively less fine, initial refining step, and the second refiner 204 continues to refine the fibers to provide surface enhanced pulp fibers. As shown in FIG. 2, the fibers can be recirculated in the second refiner 204 until the fibers have circulated through the refiner 204 a desired number of times, for example until a desired energy consumption is reached. Alternatively, rather than recirculating the fibers in the second refiner 204, additional refiners may be arranged in series after the second refiner 204 to further refine the fibers, and any such refiners can include a recirculation loop if desired. While not shown in FIG. 1, depending on the energy output of the initial refiner 202, and the desired energy to be applied to the fibers in the initial refinement stage, some embodiments may include recirculation of the fibers through the initial refiner 202 prior to transport to the second refiner 204. The number of refiners, the potential use of recirculation, and other decisions related to arrangement of refiners for providing surface enhanced pulp fibers can depend on a number of factors including the amount of manufacturing space available, the cost of refiners, any refiners already owned by the manufacturer, the potential energy output of the refiners, the desired energy output of the refiners, and other factors.

In one non-limiting embodiment, the initial refiner 202 can utilize a pair of refining disks each having a bar width of 1.0 millimeters and a groove width of 2.0 millimeters. The second refiner 204 can have a pair of refining disks each having a bar width of 1.0 millimeters and a groove width of 1.3 millimeters. The fibers, in such an embodiment, can be refined in the first refiner at a specific edge load of 0.25 Ws/m until a total energy consumption of about 80 kWh/ton is reached. The fibers can then be transported to the second refiner 204 where they can be refined and recirculated at a specific edge load of 0.13 Ws/m until a total energy consumption of about 300 kWh/ton is reached.

The remaining steps and features of the system embodiment shown in FIG. 2 can be the same as those in FIG. 1.

Various non-limiting embodiments of the present invention will now be illustrated in the following, non-limiting examples.

EXAMPLES

Example I

In this Example, surface enhanced pulp fibers according to some embodiments of the present invention were evaluated for their potential in enhancing wet web strength. Wet web strength is generally understood to correlate to paper machine runnability of pulp fibers. As a reference point, conventionally-refined softwood fibers have twice the wet web strength of conventionally refined hardwood fibers at a given freeness. For example, at a freeness of 400 CSF, a wet sheet of paper formed from conventionally refined softwood fibers might have a wet web tensile strength of 200 meters whereas a wet sheet of paper formed from conventionally refined hardwood fibers might have a wet web tensile strength of 100 meters.

In the below Examples, surface enhanced pulp fibers according to some embodiments of the present invention were added to a typical paper grade furnish comprising a mixture of conventionally refined hardwood fibers and conventionally refined softwood fibers. The relative amounts of hardwood fibers, softwood fibers and surface enhanced pulp fibers are specified in Tables 1 and 2.

Table 1 compares wet web properties of Examples 1-8, incorporating surface enhanced pulp fibers according to some embodiments of the present invention, to Control A formed only from conventionally refined hardwood and softwood fibers. The conventionally refined hardwood fibers used in Control A and Examples 1-8 were Southern hardwood fibers refined to 435 mL CSF. The conventionally refined softwood fibers used in Control A and Examples 1-8 were Southern softwood fibers refined to 601 mL CSF.

The surface enhanced pulp fibers, according to some embodiments of the present invention, used in Examples 1-8 were formed from typical unrefined Southern hardwood fibers. The unrefined hardwood fibers were introduced to a disk refiner with a pair of refining disks each having a bar width of 1.0 millimeters and a groove width of 1.3 millimeters at a specific edge load of 0.2 Ws/m. The fibers were refined as a batch until an energy consumption of 400 or 600 kWh/ton (as specified in Table 1) was reached. The surface enhanced pulp fibers that were refined until an energy consumption of 400 kWh/ton had a length weighted average fiber length of 0.81 millimeters, and the surface enhanced pulp fibers that were refined until an energy consumption of 600 kWh/ton had a length weighted average fiber length of 0.68 millimeters. The length weighted average fiber length was measured using a LDA 96 Fiber Quality Analyzer in accordance with the procedures specified in the manual accompanying the Fiber Quality Analyzer. The length weighted average fiber length was calculated using the formula for (Lw) provided above.

The wet web tensile strength of some surface enhanced pulp fibers from those batches was evaluated separately before combining other surface enhanced pulp fibers from those batches with conventionally refined hardwood fibers and conventionally refined softwood fibers to form handsheets and for evaluation as set forth below in connection with Examples 1-8. A typical paper grade furnish was prepared using the surface enhanced pulp fibers. Standard 20

GSM (grams per square meter) handsheets were formed from the furnish and tested for wet web strength at 30% dryness in accordance with Pulp and Paper Technical Association of Canada ("PAPTAC") Standard D.23P. The handsheets formed from the surface enhanced pulp fibers refined until an energy consumption of 400 kWh/ton had a wet web tensile strength of 8.91 kilometers. The handsheets formed from the surface enhanced pulp fibers refined until an energy consumption of 600 kWh/ton had a wet web tensile strength of 9.33 kilometers.

A typical paper grade furnish was prepared using the specified amounts of hardwood fibers, softwood fibers, and surface enhanced pulp fibers. Standard 60 GSM (grams per square meter) handsheets were formed from the furnish and tested for wet web strength at 30% dryness in accordance with Pulp and Paper Technical Association of Canada ("PAPTAC") Standard D.23P. The results of the tests are provided in Table 1 with "Hwd" referring to conventionally refined hardwood fibers, "Swd" referring to conventionally refined softwood fibers", "SEPF" referring to surface enhanced pulp fibers according to embodiments of the present invention, "SEPF Ref. Energy" referring to the refining energy used to form the surface enhanced pulp fibers, "WW Tensile % increase" referring to the increase in wet web tensile strength compared to Control A, and "Wet Web TEA" referring to wet web tensile energy absorption. The same conventionally refined hardwood fibers and conventionally refined softwood fibers were used in Control A and Examples 1-8.

TABLE 1

| Example | Fiber Content | SPEF Ref. Energy (kWh/ton) | Wet Web Tensile (meters) | WW Tensile % Increase | Wet Web Stretch (meters) | Wet Web TEA ($J/m^2$) |
|---|---|---|---|---|---|---|
| Control A | 60% Hwd<br>40% Swd | — | 142 | — | 7.3 | 4.4 |
| 1 | 55% Hwd<br>40% Swd<br>5% SEPF | 400 | 154 | 8 | 9.6 | 7.3 |
| 2 | 50% Hwd<br>40% Swd<br>10% SEPF | 400 | 178 | 25 | 13.0 | 7.3 |
| 3 | 65% Hwd<br>30% Swd<br>5% SEPF | 400 | 157 | 11 | 9.5 | 6.4 |
| 4 | 70% Hwd<br>20% Swd<br>10% SEPF | 400 | 177 | 25 | 9.6 | 6.8 |
| 5 | 55% Hwd<br>40% Swd<br>5% SEPF | 600 | 171 | 20 | 10.4 | 7.3 |
| 6 | 50% Hwd<br>40% Swd<br>10% SEPF | 600 | 213 | 50 | 14.4 | 10.3 |
| 7 | 65% Hwd<br>30% Swd<br>5% SEPF | 600 | 154 | 8 | 7.5 | 5.1 |
| 8 | 70% Hwd<br>20% Swd<br>10% SEPF | 600 | 180 | 27 | 7.5 | 7.5 |

Table 2 compares wet web properties of Examples 9-13, incorporating surface enhanced pulp fibers according to some embodiments of the present invention, to Control B formed only from conventionally refined hardwood and softwood fibers. The conventionally refined hardwood fibers used in Control B and Examples 9-13 were Northern hardwood fibers refined to 247 mL CSF. The conventionally refined softwood fibers used in Control B and Examples 9-13 were Northern softwood fibers refined to 259 mL CSF.

The surface enhanced pulp fibers used in Examples 9-13 were formed from typical unrefined Southern hardwood fibers. The unrefined hardwood fibers were introduced to a disk refiner with a pair of refining disks each having a bar width of 1.0 millimeters and a groove width of 1.3 millimeters at a specific edge load of 0.2 Ws/m. The fibers were refined as a batch until an energy consumption of 400 kWh/ton or 600 kW/ton (as specified in Table 2) was reached.

A typical paper grade furnish was prepared using the specified amounts of hardwood fibers, softwood fibers, and surface enhanced pulp fibers. Standard 60 GSM (grams per square meter) handsheets were formed from the furnish and tested for wet web strength at 30% dryness in accordance with PAPTAC Standard D.23P. The results of the tests are provided in Table 2 with "Hwd" referring to conventionally refined hardwood fibers, "Swd" referring to conventionally refined softwood fibers", "SEPF" referring to surface enhanced pulp fibers according to some embodiments of the present invention, "SEPF Ref. Energy" referring to the refining energy used to form the surface enhanced pulp fibers, "WW Tensile % increase" referring to the increase in wet web tensile strength compared to Control B, and "Wet Web TEA" referring to wet web tensile energy absorption. The same conventionally refined hardwood fibers and conventionally refined softwood fibers were used in Control B and Examples 9-13.

TABLE 2

| Example | Fiber Content | SPEF Ref. Energy (kWh/ton) | Wet Web Tensile (meters) | WW Tensile % Increase | Wet Web Stretch (meters) | Wet Web TEA ($J/m^2$) |
|---|---|---|---|---|---|---|
| Control B | 50% Hwd<br>50% Swd | — | 279 | — | 9.7 | 13.1 |
| 9 | 25% Hwd<br>50% Swd<br>25% SEPF | 400 | 405 | 45 | 12.6 | 17.8 |
| 10 | 10% Hwd<br>40% Swd<br>50% SEPF | 400 | 2158 | 673 | 13.6 | 26.6 |
| 11 | 25% Hwd<br>50% Swd<br>25% SEPF | 600 | 2103 | 654 | 13.6 | 24.0 |
| 12 | 10% Hwd<br>40% Swd<br>50% SEPF | 600 | 2172 | 678 | 13.5 | 27.7 |
| 13 | 40% Hwd<br>50% Swd<br>10% SEPF | 400 | 359 | 29 | 11.7 | 15.7 |

As shown above, the addition of 25% surface enhanced pulp fibers according to some embodiments of the present invention can increase the wet web tensile strength by 45-653%. Likewise, the addition of 50% surface enhanced pulp fibers according to some embodiments of the present invention can increase the wet web tensile strength by 673% and higher.

To summarize, Examples 1-13 clearly show that when surface enhanced pulp fibers are incorporated into a furnish, the wet web tensile strength of wet sheets of paper formed from the furnish is enhanced. This likewise indicates numerous potential benefits for paper machine operations including, for example, improved runnability, equal or improved runnability with a lower amount of softwood fibers in the furnish, increased filler in the furnish without affecting machine runnability, and others.

Example II

In this Example, paper samples incorporating surface enhanced pulp fibers according to some embodiments of the present invention were manufactured and tested to determine potential benefits associated with incorporation of the surface enhanced pulp fibers.

In the below Examples, paper samples were made using conventional paper manufacturing techniques with the only differences being the relative amounts of hardwood fibers, softwood fibers, and surface enhanced pulp fibers. The conventionally refined hardwood fibers used in Control C and Examples 14-15 were Southern hardwood fibers refined until an energy consumption of about 50 kWh/ton was reached. The conventionally refined softwood fibers used in Control C and Examples 14-15 were Southern softwood fibers refined until an energy consumption of about 100 kWh/ton was reached.

The surface enhanced pulp fibers used in Examples 14-15 were formed from typical unrefined Southern hardwood fibers. The unrefined hardwood fibers were introduced to two disk refiners aligned in series. The first refiner had a pair of refining disks each having a bar width of 1.0 millimeters and a groove width of 2.0 millimeters. The second refiner had a pair of refining disks each having a bar width of 1.0 millimeters and a groove width of 1.3 millimeters. The fibers were refined in the first refiner at a specific edge load of 0.25 Ws/m followed by a second refiner where they were refined at a specific edge load of 0.13 Ws/m until a total energy consumption of about 400 kWh/ton was reached. The length weighted average fiber length of the surface enhanced pulp fibers was measured to be 0.40 millimeters wherein the number of surface enhanced pulp fibers was at 12,000 fibers per milligram on an oven-dry basis. The length weighted average fiber length was measured using a LDA 96 Fiber Quality Analyzer in accordance with the procedures specified in the manual accompanying the Fiber Quality Analyzer. The length weighted average fiber length was calculated using the formula for (Lw) provided above.

A typical paper grade furnish was prepared using the specified amounts of hardwood fibers, softwood fibers, and surface enhanced pulp fibers. The furnish was then processed into paper samples using conventional manufacturing techniques. The paper samples had basis weights of 69.58 g/m.sup.2 (Control C), 70.10 g/m.sup.2 (Example 14), and 69.87 g/m.sup.2 (Example 15). The paper samples were tested for bulk, tensile strength, porosity, and stiffness, brightness, opacity, and other properties. The paper samples were also sent for commercial print testing to evaluate their overall print performance. The tensile strengths in the machine direction and cross direction were measured in accordance with PAPTAC Procedure No. D.12. The porosities were measured using a Gurley Densometer in accordance with PAPTAC Procedure No. D.14. The stiffness in the machine direction and cross direction were measured using a Taber-type tester in accordance with PAPTAC Procedure No. D.28P. Each of the other properties reported in Table 3 were measured in accordance with the appropriate PAPTAC test procedure. The results of the tests are provided in Table 3 with "Hwd" referring to conventionally refined hardwood fibers, "Swd" referring to conventionally refined softwood fibers", "SEPF" referring to surface enhanced pulp fibers according to some embodiments of the present invention, "md" in connection with various properties referring to that property's value in the machine direction, and "cd" in connection with various properties referring to that property's value in the cross direction.

TABLE 3

| Fiber Content | Control C 78% Hwd 22% Swd | Example 14 75% Hwd 20% Swd 5% SEPF | Example 15 85% Hwd 5% Swd 10% SEPF |
|---|---|---|---|
| Bulk ($cm^3/g$) | 1.41 | 1.45 | 1.43 |
| Burst Index ($kPa \cdot m^2/g$) | 2.72 | 2.73 | 2.75 |
| Tear index (4-ply), md ($mN \cdot m^2/g$) | 6.13 | 6.17 | 6.05 |
| Tear index (4-ply), cd ($mN\text{-}m^2/g$) | 6.87 | 7.08 | 6.49 |
| Tensile index, md ($N \cdot m/g$) | 69.1 | 68.4 | 68.9 |
| Tensile index, cd ($N \cdot m/g$) | 33.2 | 32.5 | 33.8 |
| Tensile, md (km) | 7.04 | 6.97 | 7.02 |
| Tensile, cd (km) | 3.38 | 3.32 | 3.44 |
| Stretch, md (%) | 1.69 | 1.65 | 1.70 |
| Stretch, cd (%) | 5.24 | 5.46 | 5.49 |
| Tensile Energy Absorption, md ($J/m^2$) | 52.8 | 51.7 | 53.6 |
| Tensile Energy Absorption, cd ($J/m^2$) | 86.8 | 91.4 | 94.8 |
| Porosity, Gurley (sec/100 mL) | 15 | 19 | 20 |
| Stiffness, Taber, md ($g \cdot m$) | 2.12 | 2.36 | 2.40 |
| Stiffness, Taber, cd ($g \cdot m$) | 1.28 | 1.30 | 1.30 |
| Internal Bond, md ($0.001\ ft \cdot lb/in^2$) | 214 | 223 | 220 |
| Internal Bond, cd ($0.001\ ft \cdot lb/in^2$) | 225 | 246 | 233 |
| Opticals: | | | |
| Brightness, ISO, top (%) | 96.7 | 97.0 | 96.5 |
| Brightness, ISO, bottom (%) | 96.6 | 96.9 | 96.5 |
| Opacity, ISO, top (%) | 90.6 | 91.3 | 91.6 |
| Opacity, ISO, bottom (%) | 90.6 | 91.2 | 91.4 |

The data in Table 3 demonstrate that the amount of softwood fibers in the paper samples can be reduced from 22% to 5% with the addition of 10% surface enhanced pulp fibers according to some embodiments of the present invention while maintaining the caliper and physical strength properties of the paper within the specifications for the paper grade, and without affecting the drainage and runnability of the paper machine.

Example III

In this Example, the average hydrodynamic specific surface areas of various surface enhanced pulp fibers were measured. Some of these Examples represent embodiments of surface enhanced pulp fibers of the present invention, while some do not.

The surface enhanced pulp fibers used in Examples 16-30 were formed from typical unrefined Southern hardwood fibers. The unrefined hardwood fibers were introduced to a disk refiner with a pair of refining disks at a specific edge load of 0.25 Ws/m. As set forth in Table 4 below, some of the hard wood fibers were refined using disks having a bar width of 1.0 millimeters and a groove width of 1.3 millimeters, and others were refined using disks having a bar width of 1.0 millimeters and a groove width of 2.0 millimeters. The fibers were refined as a batch until the energy consumption specified in Table 4 was reached.

The hydrodynamic specific surface areas of the surface enhanced pulp fibers were measured pursuant to the procedure specified in *Characterizing the Drainage Resistance of Pulp and Microfibrillar Suspensions using Hydrodynamic Flow Measurements*, N. Lavrykova-Marrain and B. Ramarao, TAPPI's PaperCon 2012 Conference, The results are provided in Table 4.

TABLE 4

| Example | Disk Dimensions (bar width × groove width) | SPEF Ref. Energy (kWh/ton) | Avg. Hydrodynamic Specific Surface Area ($m^2/g$) |
|---|---|---|---|
| 16 | 1.0 mm × 1.3 mm | 0 | 1.9 |
| 17 | 1.0 mm × 1.3 mm | 41 | 2.8 |
| 18 | 1.0 mm × 1.3 mm | 82 | 3.3 |
| 19 | 1.0 mm × 1.3 mm | 123 | 4.9 |
| 20 | 1.0 mm × 1.3 mm | 165 | 6.9 |
| 21 | 1.0 mm × 1.3 mm | 206 | 8.2 |
| 22 | 1.0 mm × 1.3 mm | 441 | 23.3 |
| 23 | 1.0 mm × 1.3 mm | 615 | 48.7 |
| 24 | 1.0 mm × 2.0 mm | 0 | 1.9 |
| 25 | 1.0 mm × 2.0 mm | 40 | 2.2 |
| 26 | 1.0 mm × 2.0 mm | 80 | 3.5 |
| 27 | 1.0 mm × 2.0 mm | 120 | 4.6 |
| 28 | 1.0 mm × 2.0 mm | 160 | 6.3 |
| 29 | 1.0 mm × 2.0 mm | 200 | 13.5 |
| 30 | 1.0 mm × 2.0 mm | 400 | 16.2 |

The data from Table 4 demonstrate that finer bars on the refiner plates results in greater fibrillation and higher specific surface area.

General

Unless indicated to the contrary, the numerical parameters set forth in this specification are approximations that can vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10. Additionally, any reference referred to as being "incorporated herein" is to be understood as being incorporated in its entirety.

It is further noted that, as used in this specification, the singular forms "a," "an," and "the" include plural referents unless expressly and unequivocally limited to one referent.

It is to be understood that the present description illustrates aspects of the invention relevant to a clear understanding of the invention. Certain aspects of the invention that would be apparent to those of ordinary skill in the art and that, therefore, would not facilitate a better understanding of the invention have not been presented in order to simplify the present description. Although the present invention has been described in connection with certain embodiments, the present invention is not limited to the particular embodiments disclosed, but is intended to cover modifications that are within the spirit and scope of the invention, as defined by the appended claims.

The invention claimed is:

1. A paper product comprising:

a plurality of surface enhanced pulp fibers formed from a hardwood and having a length weighted average fiber length of at least 0.3 millimeters and an average hydrodynamic specific surface area of at least 10 square meters per gram; and a plurality of softwood fibers;

wherein at least 2 percent of the paper product, by weight, is the surface enhanced pulp fibers.

2. The paper product of claim 1, wherein between 2 and 15 percent of the paper product, by weight, is the surface enhanced pulp fibers.

3. The paper product of claim 1, wherein less than 10 percent of the paper product, by weight, is the surface enhanced pulp fibers.

4. The paper product of claim 1, wherein less than 50 percent of the paper product, by weight, is the softwood fibers.

5. The paper product of claim 1, wherein between 20 and 40 percent of the paper product, by weight, is the softwood fibers.

6. The paper product of claim 5, wherein between 50 and 70 percent of the paper product, by weight, is the surface enhanced pulp fibers.

7. The paper product of claim 1, wherein the surface enhanced pulp fibers have a length weighted average fiber length of at least 0.35 millimeters and an average hydrodynamic specific surface area of at least 12 square meters per gram.

8. The paper product of claim 1, wherein the surface enhanced pulp fibers have a length weighted average fiber length of at least 0.4 millimeters and an average hydrodynamic specific surface area of at least 10 square meters per gram.

9. The paper product of claim 1, further comprising a plurality of hardwood fibers having an average hydrodynamic specific surface area that is less than the average hydrodynamic specific surface area of the surface enhanced pulp fibers.

10. The paper product of claim 9, wherein between 2 and 15 percent of the paper product, by weight, is the surface enhanced pulp fibers.

11. The paper product of claim 10, wherein between 20 and 40 percent of the paper product, by weight, is the softwood fibers.

12. The paper product of claim 10, wherein between 50 and 70 percent of the paper product, by weight, is the hardwood fibers.

13. The paper product of claim 1, wherein the surface enhanced pulp fibers have a length weighted average fiber length of at least 0.4 millimeters.

14. The paper product of claim 1, wherein the surface enhanced pulp fibers have an average hydrodynamic specific surface area of at least 12 square meters per gram.

15. The paper product of claim 1, wherein the surface enhanced pulp fibers have a length weighted fines value of less than 40% when fibers having a length of 0.2 millimeters or less are classified as fines.

16. The paper product of claim 1, wherein the surface enhanced pulp fibers have a length weighted fines value of less than 22% when fibers having a length of 0.2 millimeters or less are classified as fines.

17. The paper product of claim 9, wherein less than 10 percent of the paper product, by weight, is the surface enhanced pulp fibers.

18. The paper product of claim 9, wherein less than 50 percent of the paper product, by weight, is the softwood fibers.

19. The paper product of claim 9, wherein the surface enhanced pulp fibers have a length weighted average fiber length of at least 0.35 millimeters and an average hydrodynamic specific surface area of at least 12 square meters per gram.

20. The paper product of claim 9, wherein the surface enhanced pulp fibers have a length weighted average fiber length of at least 0.4 millimeters.

21. The paper product of claim 9, wherein the surface enhanced pulp fibers have an average hydrodynamic specific surface area of at least 12 square meters per gram.

22. The paper product of claim 17, wherein the surface enhanced pulp fibers have a length weighted fines value of less than 40% when fibers having a length of 0.2 millimeters or less are classified as fines.

23. The paper product of claim 1, wherein the softwood fibers have an average hydrodynamic specific surface area that is less than the average hydrodynamic specific surface area of the surface enhanced pulp fibers.

24. A plurality of hardwood pulp fibers having:

a length weighted average fiber length of at least 0.3 millimeters; and an average hydrodynamic specific surface area of at least 10 square meters per gram.

25. The hardwood pulp fibers of claim 24, wherein the number of hardwood pulp fibers is at least 12,000 fibers per milligram on an oven-dry basis.

26. The hardwood pulp fibers of claim 24 wherein the hardwood pulp fibers have a length weighted average fiber length of at least 0.4 millimeters.

27. The hardwood pulp fibers of claim 24, wherein the hardwood pulp fibers have an average hydrodynamic specific surface area of at least 12 square meters per gram.

28. The hardwood pulp fibers of claim 27, wherein the hardwood pulp fibers have a length weighted average fiber length of at least 0.35 millimeters.

29. The hardwood pulp fibers of claim 24, wherein the hardwood pulp fibers have a length weighted fines value of less than 40% when fibers having a length of 0.2 mm or less are classified as fines.

30. The hardwood pulp fibers of claim 24, wherein the hardwood pulp fibers have a length weighted fines value of less than 22% when fibers having a length of 0.2 mm or less are classified as fines.

* * * * *